US005455595A

United States Patent [19]

Yokoyama et al.

[11] Patent Number: 5,455,595

[45] Date of Patent: Oct. 3, 1995

[54] ANTENNA FOR PORTABLE RADIO COMMUNICATION APPARATUS

[75] Inventors: Yukio Yokoyama; Kazuo Sekiya; Kenji Takamoro, all of Tokyo, Japan

[73] Assignee: NEC Corporation, Tokyo, Japan

[21] Appl. No.: 186,570

[22] Filed: Jan. 26, 1994

[30] Foreign Application Priority Data

Jan. 29, 1993 [JP] Japan ..... 5-034252

[51] Int. Cl.[6] ..... H01Q 1/24

[52] U.S. Cl. ..... 343/702; 343/900; 343/901

[58] Field of Search ..... 343/702, 900, 343/901; H01Q 1/10, 1/24, 9/30

[56] References Cited

U.S. PATENT DOCUMENTS

| | | | |
|---|---|---|---|
| 110,930 | 6/1940 | Collins | 343/702 |
| 4,860,024 | 8/1989 | Egashira | 343/702 |
| 4,868,576 | 9/1989 | Johnson | 343/900 X |
| 5,177,492 | 1/1993 | Tomura et al. | 343/900 X |

FOREIGN PATENT DOCUMENTS

| | | | |
|---|---|---|---|
| 0459391 | 12/1991 | European Pat. Off. . | |
| 0508836 | 10/1992 | European Pat. Off. | H01Q 1/24 |
| 0516490 | 12/1992 | European Pat. Off. | H01Q 1/24 |
| 0522806 | 1/1993 | European Pat. Off. | H01Q 1/24 |
| 0120103 | 6/1987 | Japan | H01Q 1/10 |
| 0016402 | 1/1991 | Japan | H01Q 1/10 |
| 2257837 | 1/1993 | United Kingdom | H01Q 1/10 |

*Primary Examiner*—Donald Hajec
*Assistant Examiner*—Tho Phan
*Attorney, Agent, or Firm*—Young & Thompson

[57] ABSTRACT

An antenna mounted on and retractable into a casing of a portable radio communication apparatus. When the antenna is pulled out of the casing, it plays the role of a λ/2 whip antenna. Even when the antenna is retracted into the casing, it has substantially the same gain as when pulled out from the casing.

4 Claims, 5 Drawing Sheets

ANTENNA FOR PORTABLE RADIO COMMUNICATION APPARATUS

BACKGROUND OF THE INVENTION

1. Field of the Invention

The present invention relates to an antenna mounted on and retractable into the casing of a portable radio communication apparatus and, more particularly, to an antenna having a sufficient gain even when retracted into the casing.

2. Description of the Related Art

It is a common practice with an antenna for the above application to use a half wavelength (λ/2) whip antenna whose gain is hardly susceptible to the human body, thereby insuring high quality conversations. However, if the λ/2 whip antenna is exposed to the outside at all times, it constitutes an obstruction and degrades the portability or mobility. In the light of this, it has been customary to allow the whip antenna to be retracted into the casing of the apparatus, as needed. This, however, brings about another problem that when the antenna is received in the casing, the antenna gain is noticeably lowered. Hence, when the user of the apparatus carries it while waiting for a call, the antenna has to be held in an extended position, also degrading the portability.

Japanese Utility Model Laid-Open Publication No. 61-57608, for example, teaches a rod antenna having a coil-like portion at the tip thereof, and a cover made of synthetic resin and covering the coil-like portion. The problem with this kind of antenna is that when it is applied to a portable radio communication apparatus and received in the casing of the apparatus, it cannot have the same gain as when pulled out of the casing.

SUMMARY OF THE INVENTION

It is, therefore, an object of the present invention to provide an antenna for a portable radio communication apparatus which achieves the same gain when retracted in the casing of the apparatus as when fully extended.

An antenna mounted on and retractable into the casing of a portable radio communication apparatus of the present invention comprises a first conductor covered with an insulator, a tubular second conductor for receiving the first conductor, a connection conductor fitted on the lower end of the first conductor for maintaining the first conductor and second conductor in contact at all times, a cover member covering the upper end portion of the first conductor over a predetermined length and having a greater diameter than the second conductor, and a metallic grounding part for contacting the lower end of the second conductor when the antenna is retracted into the casing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 5:
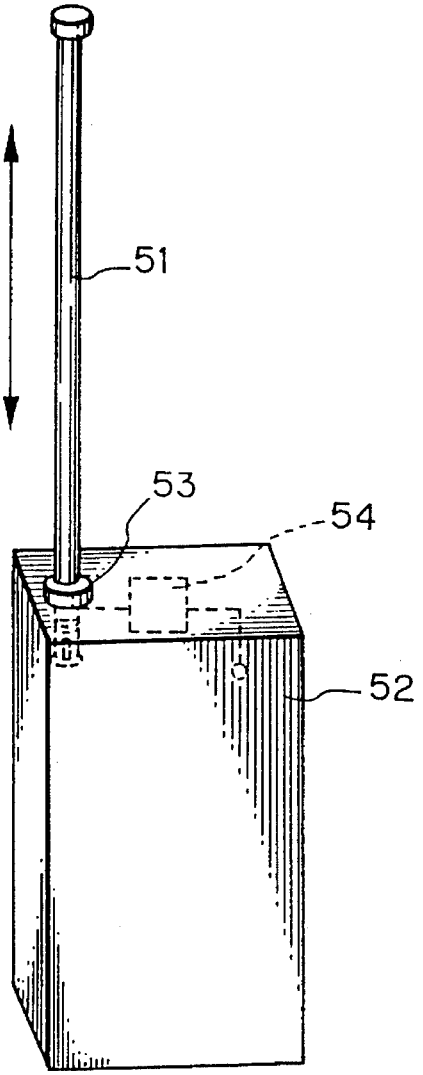
Fig. 5 PRIOR ART
FIG. 5 is a perspective view showing a conventional antenna and a radio communication apparatus implemented therewith.

To better understand the present invention, a brief reference will be made to a conventional antenna and a portable radio communication apparatus using it, shown in FIG. 5. As shown, the apparatus has a casing 52 on which a metallic retainer 53 is fixed in place. A whip antenna 51 is held by the retainer 53 and is movable into the casing 52, as desired. A matching circuit 54 feeds the whip antenna 51 via the metallic retainer 53. The matching circuit 54 is used to match the input impedance of the whip antenna 51, which is as high as several hundred ohms, to the feed ratio (generally, characteristic impedance of 50 ohms).

Figure 6:
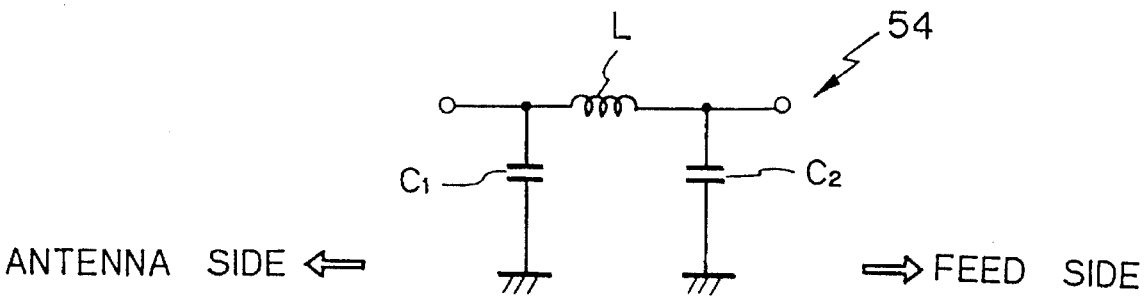
Fig. 6 PRIOR ART
FIG. 6 shows an equivalent circuit representative of a matching section associated with the conventional antenna.

FIG. 6 shows an equivalent circuit representative of the matching circuit 54. There are shown in the figure capacitors having lumped constants or stray capacities $C_1$ and $C_2$ between the terminals and the casing 52, and a coil of conductor or pattern L formed on a printed circuit board.

However, the problem with the conventional apparatus is that the gain is noticeably lowered when the whip antenna 51 is received in the casing 52. Therefore, when the user of the apparatus carries it while waiting for a call, the antenna 51 has to be maintained in the extended position.

Figure 1A:
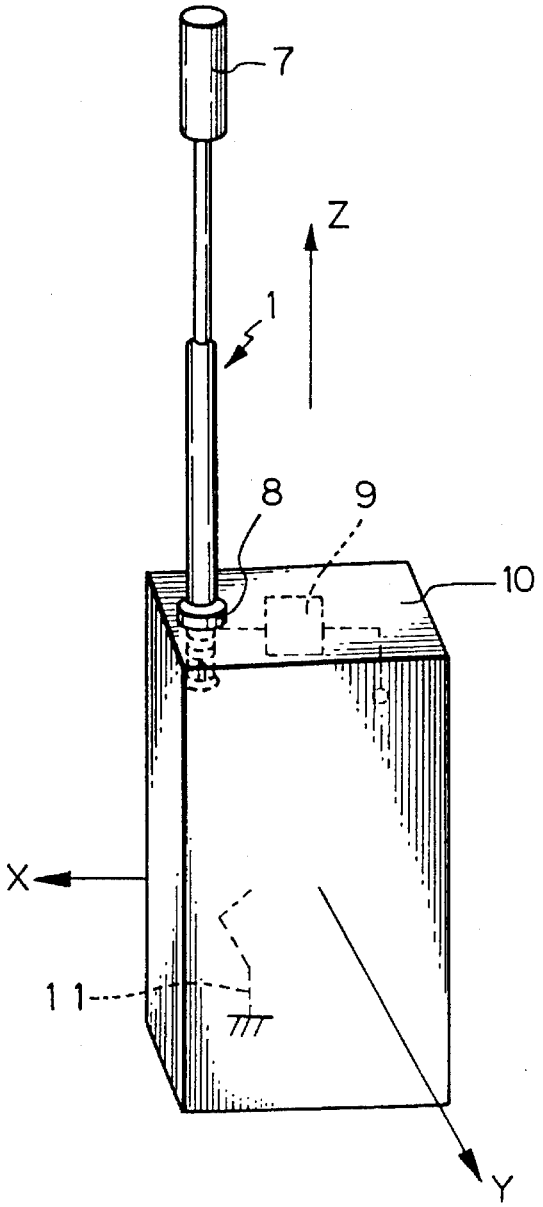
FIGS. 1A and 1B respectively show an antenna embodying the present invention in a position extended from the casing of a portable radio communication apparatus and in a position retracted into the casing.
Figure 1B:
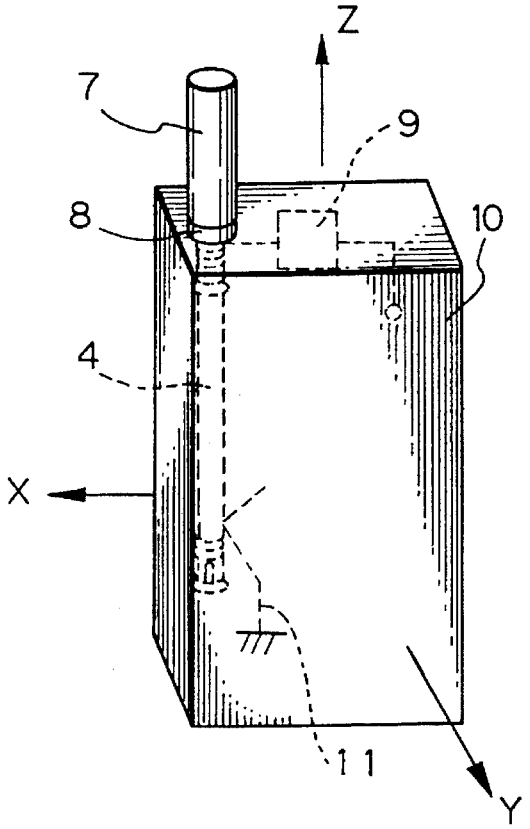
Figure 2:
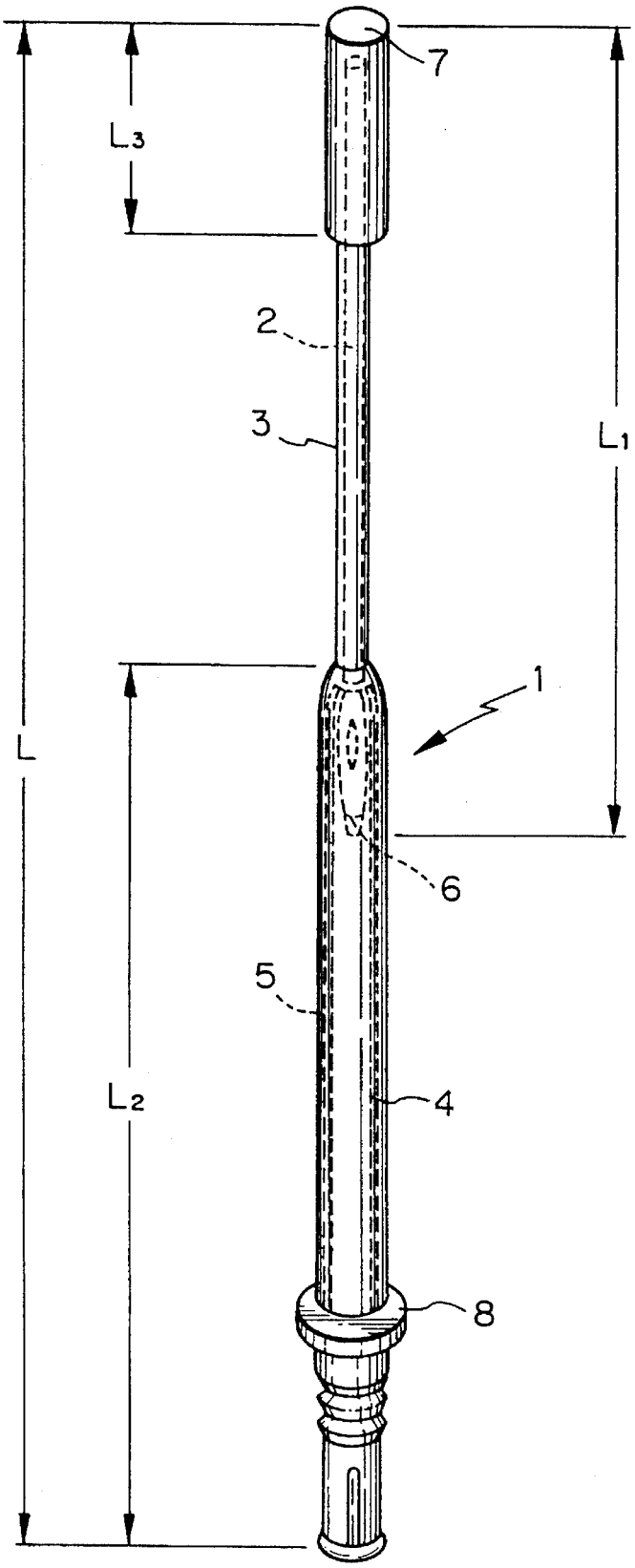
FIG. 2 shows the antenna of FIG. 1 in detail.

Referring to FIGS. 1A and 1B, an antenna embodying the present invention will be described. As shown, an antenna 1 is mounted on a casing 10 included in a portable radio communication apparatus. The antenna 1 is retractable into the casing 10, as desired.

As shown in FI6. 2, the antenna 1 is made up of a first conductor 2 having a length $L_1$, an insulator 3 covering the first conductor 2, a second conductor 4 having a length $L_2$ and implemented by a hollow rod-like conductor for receiving the conductor 2 enclosed by the insulator 3, an insulator 5 covering the second conductor 4, and a connection conductor 6 fitted on the lower end of the conductor 2 for maintaining the conductors 2 and 4 in contact. A cover member 7 is made of an insulator or a conductor and formed on the tip or upper end of the antenna 1. When the antenna 1 is received in the casing 10, the cover member 7 causes a part of the first conductor 1 to remain exposed to the outside of the casing 10 over a length $L_3$. The cover member 7 has a diameter greater than the diameter of the second conductor 4, so that it will not enter the casing 10 when the antenna 1 is retracted into the casing 10. A metallic retainer 8 is provided on the lower end portion or root portion of the second conductor 4 in order to affix the antenna 1 to the casing 10 and to feed the antenna 1. As shown in FIG. 1A, a matching circuit 9 and a metallic part 11 for grounding are accommodated in the casing 10. The matching circuit 9 feeds the antenna 1 via the retainer 8. When the antenna 1 is received in the casing 10, the metallic part 11 contacts the lower end of the second conductor 4 to connect it to ground.

As shown in FIG. 1A, when the antenna 1 mounted on the casing 10 is pulled out of the casing 10, it is held by the retainer 8 affixed to the casing 10. In this condition, the matching circuit 9 feeds the antenna 1 via the retainer 8. As shown in FIG. 1B, when the antenna is retracted in the casing 10, only a part of the first conductor 2 which is enclosed by the insulative or conductive cover member 7 is left outside of the casing 10. At this instant, the lower end of the second conductor 4 is connected to ground via the metallic part 11.

The length L of the antenna 1 is selected to be about $\lambda/2$ when the antenna 1 is extended. Hence, in the extended position, the antenna 1 serves as a $\lambda/2$ whip antenna. On the other hand, in the retracted position, the part of the antenna 1 enclosed by the cover member 7 and left outside of the casing 10 over the length $L_3$ plays the role of an antenna. Specifically, in the retracted position, since the upper end of the second conductor 4 and the retainer 8 are connected with respect to high frequency and feed, even the part of the antenna 1 retracted in the casing 10 is driven and contributes to the antenna characteristic. Presumably, this is derived from the following occurrence.

Figure 3:
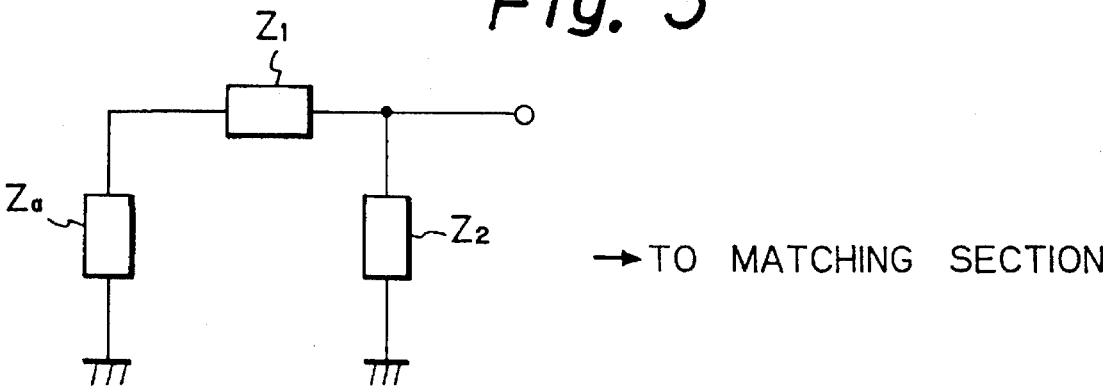
FIG. 3 shows an equivalent circuit representative of the antenna received in the casing.

FIG. 3 shows an equivalent circuit presumably representative of the antenna 1 received in the casing 10. As shown, the circuit includes an impedance $Z_a$ particular to the upper end of the first conductor 2 and equal to the impedance of a whip antenna having a length $L_3$. Since the first conductor 2 is covered with the insulator 3, it does not contact the second conductor 4, although it is short-circuited by the connection conductor 6 in the retracted position of the antenna 1. Hence, a coaxial structure whose one end is short-circuited by the conductors 2 and 4 is set up. This coaxial structural portion has an impedance $Z_1$. An impedance $Z_2$ is set up when the lower end of the second conductor 4 is connected to ground via the metallic part 11. Such an antenna system is connected to a feed section via the matching circuit 9.

Since the length $L_3$ in the retracted position of the antenna 1 is selected to be as small as possible, the impedance $Z_a$ exhibits a capacitance having a small real portion (resistance) and a large imaginary portion (reactance), compared to a $\lambda/2$ whip antenna. Therefore, when the lengths $L_1$ and $L_2$ of the first and second conductors 2 and 4, respectively, are changed, the impedances $Z_1$ and $Z_2$ change. It follows that by adequately selecting the lengths $L_1$ and $L_2$, it is possible to convert the impedance $Z_a$ to a value substantially equal to the antenna impedance in the extended position. As a result, a single matching circuit 9 suffices for both of the extended and retracted positions of the antenna 1, i.e., substantially the same gain is achievable in both of the extended and retracted positions.

Figure 4A:
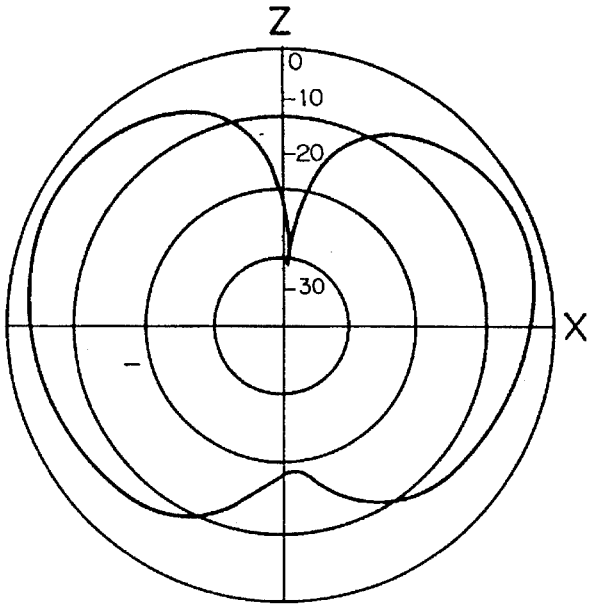
FIGS. 4A and 4B show radiation patterns achievable when the antenna is extended and retracted, respectively.
Figure 4B:
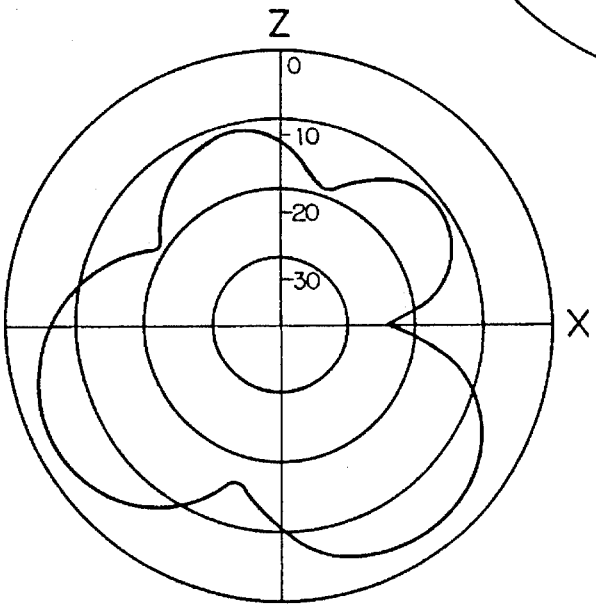

A specific example of the antenna 1 will be described hereinafter. In the example, the antenna 1 was exposed to the outside over a length $L_3$ of about 25 mm in the retracted position and had a length L of 165 mm in the extended position. The first and second conductors 2 and 4 respectively had a length $L_1$ of 87 mm and a length $L_2$ of 86 mm. FIGS. 4A and 4B show radiation patterns occurred when the antenna 1 was extended and retracted, respectively. The frequency for measurement was 935 MHz. The two radiation patterns shown in FIGS. 4A and 4B are different from each other since a current flows to both the antenna 1 and the casing 10 in the retracted position, but it mainly flows to the antenna 1 in the extended position. However, the peak value of the gain in the retracted position is only about 3 dB lower than the peak value in the extended position. This indicates that the antenna 1 has an excellent characteristic.

Figure 7:
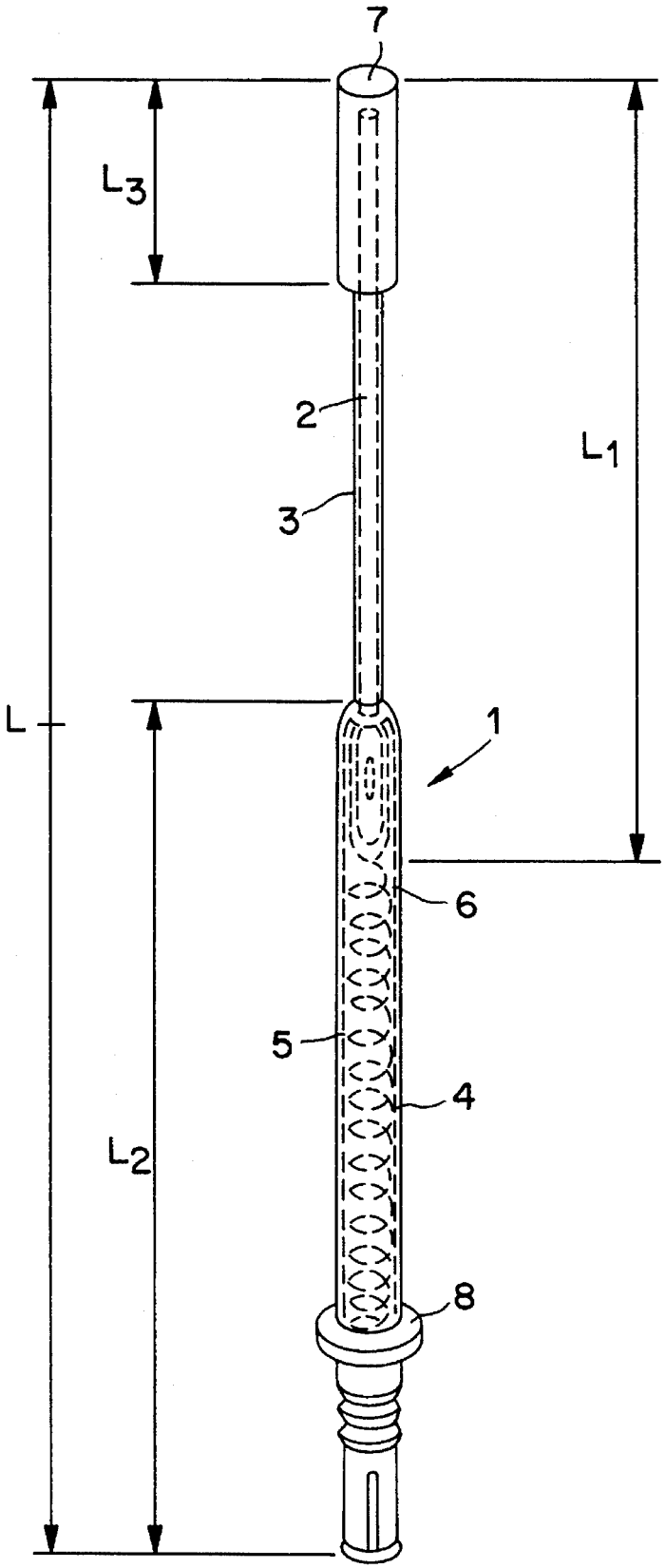
FIG. 7 shows an embodiment of the antenna of FIG. 1 in detail where the second conductor 4 has been replaced with a spiral conductive coil.

If desired, the second conductor 4 may be replaced with a spiral conductive coil turned without any gap, as shown in FIG. 7. The conductive coil not only achieves the above-stated characteristic but also provides the antenna 1 with flexibility, which is desirable from the damage standpoint. Further, the spiral conductor constituting the second conductor 4 may be provided with a gap in a part thereof so as to increase the inductance, in which case the length of the conductor 4 will be reduced in matching relation to the gap. The insulator 5 associated with the second conductor 4 is omissible since it mainly serves to provide the antenna 1 with attractive appearance.

In summary, it will be seen that the present invention provides an antenna which plays the role of a $\lambda/2$ whip antenna when extended and has substantially the same gain both in the extended and retracted positions thereof. Furthermore, when a second conductor included in the antenna is implemented as a coil, it provides the antenna with flexibility.

Various modifications will become possible for those skilled in the art after receiving the teachings of the present disclosure without departing from the scope thereof.

What is claimed is:

1. An antenna mounted on and retractable into a casing of a portable radio communication apparatus, comprising:

a first movable axial extending conductor covered with an insulator;

a tubular second movable conductor for receiving said first conductor therein;

a connection conductor fitted on a lower end of said first conductor for maintaining said first conductor and said second conductor in contact at all times;

a cover member covering an upper end portion of said first conductor over a predetermined length and having a greater diameter than said second conductor to thereby prevent retraction of said upper end portion into said casing when said antenna is retracted into said casing; and a metallic grounding part for grounding a lower end of said second conductor only when said antenna is retracted into said casing;

a length of said first conductor and a length of said second conductor being chosen so that an impedance of said upper end portion of said first conductor when said antenna is in a retracted position is substantially equal to an impedance of said antenna in an extended position.

2. An antenna as claimed in claim 1, wherein said second conductor comprises a hollow rod-like conductor.

3. An antenna as claimed in claim 1, wherein said second conductor comprises a spiral conductive coil turned without any gap.

4. An antenna as claimed in claim 1, wherein said second conductor comprises a conductive spiral coil having a gap in a part thereof.

* * * * *